US011560999B2

(12) United States Patent
Xue et al.

(10) Patent No.: US 11,560,999 B2
(45) Date of Patent: Jan. 24, 2023

(54) LIGHT FIXTURE WITH ROTATABLE LIGHT SOURCE

(71) Applicants: Self Electronics Co., Ltd., Zhejiang (CN); Wanjiong Lin, Zhejiang (CN); Self Electronics USA Corporation, Norcross, GA (US)

(72) Inventors: Yuanfang Xue, Zhejiang (CN); Yingdi Li, Zhejiang (CN); Junjun Ying, Zhejiang (CN); Huangfeng Pan, Zhejiang (CN); Quan Zhu, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/949,682

(22) Filed: Nov. 10, 2020

(65) Prior Publication Data

US 2021/0199268 A1 Jul. 1, 2021

(30) Foreign Application Priority Data

Dec. 27, 2019 (CN) ..... 201911379369.7

(51) Int. Cl.

| | |
|---|---|
| ***F21V 14/02*** | (2006.01) |
| ***H05B 45/10*** | (2020.01) |
| ***F21V 3/02*** | (2006.01) |
| ***F21V 5/04*** | (2006.01) |
| ***F21V 21/30*** | (2006.01) |
| ***F21V 23/00*** | (2015.01) |

(Continued)

(52) U.S. Cl.

CPC ..... *F21V 14/02* (2013.01); *F21V 3/02* (2013.01); *F21V 5/045* (2013.01); *F21V 21/30* (2013.01); *F21V 23/003* (2013.01); *H05B 45/10* (2020.01); *F21Y 2107/40* (2016.08); *F21Y 2115/10* (2016.08)

(58) Field of Classification Search

CPC . F21V 14/02; F21V 3/02; F21V 5/045; F21V 21/30; F21V 23/003; H05B 45/10

See application file for complete search history.

(56) References Cited

U.S. PATENT DOCUMENTS

2007/0097681 A1* 5/2007 Chich ..... F21V 14/02 362/555
2011/0211364 A1* 9/2011 Lutz ..... A47G 33/06 362/555

(Continued)

*Primary Examiner* — Diane I Lee
*Assistant Examiner* — Nathaniel J Lee
(74) *Attorney, Agent, or Firm* — Wang Law Firm, Inc.

(57) ABSTRACT

A light fixture with rotatable light source includes a fixed lamp holder, a rotatable lamp holder, a light source assembly, a power source and a transmission mechanism; and the light of the light source assembly has strong and weak changes while rotating with the rotatable lamp holder within the circumferential range of the rotation centerline; the power source and the transmission mechanism are used to drive the rotatable lamp holder to rotate relative to the fixed lamp holder. The light fixture with rotatable light source drives the light source assembly to rotate through the rotatable lamp holder, the light intensity changes during the light source assembly rotates around the center line of rotation. The light fixture will produce a sparkling effect especially suitable for jewelry lighting, so that jewelry is shining at all times.

20 Claims, 5 Drawing Sheets

(51) Int. Cl.
*F21Y 107/40* (2016.01)
*F21Y 115/10* (2016.01)

(56) References Cited

U.S. PATENT DOCUMENTS

2014/0301071 A1* 10/2014 Jorgensen ..... F21V 14/06
362/231
2015/0159842 A1* 6/2015 Zhang ..... F21V 31/00
362/231
2015/0211708 A1* 7/2015 Stavely ..... G02B 3/0056
362/231
2016/0178165 A1* 6/2016 Quadri ..... F21V 21/30
362/232
2016/0369979 A1* 12/2016 Song ..... F21V 11/02
2022/0000285 A1* 1/2022 Xue ..... F21V 3/00

* cited by examiner

LIGHT FIXTURE WITH ROTATABLE LIGHT SOURCE

RELATED APPLICATION

This application claims priority to a Chinese Patent Application No. CN 201911379369.7, filed on Dec. 27, 2019.

FIELD OF THE TECHNOLOGY

The present invention relates to the field of display cabinet lamps, with particular emphasis on a light fixture with rotatable light source.

BACKGROUND OF THE INVENTION

In order to improve the brightness of the products placed in the existing showcases, lighting lamps are installed in the showcases, especially in jewelry lighting. There has been no effective way to improve the user experience of consumers. Existing lamps and lanterns have always been a last resort lighting demand for jewelry sellers. They do not improve the shopping experience of consumers very well. Instead, they will cause certain damage to consumers' eyes because of the long staring time.

At present, all the lamps used for jewelry display on the market cannot bring consumers a better jewelry appreciation experience.

BRIEF SUMMARY OF THE INVENTION

In view of this, the present invention provides a light fixture with rotatable light source to solve the above technical problems.

A light fixture with rotatable light source, comprising: a fixed lamp holder, a rotatable lamp holder, a light source assembly, a power source and a transmission mechanism; wherein:

the fixed lamp holder has a rotation centerline;

the rotatable lamp holder rotates around the rotation centerline and is arranged on the fixed lamp holder;

the light source assembly is arranged on the rotatable lamp holder, and the light of the light source assembly has strong and weak changes while rotating with the rotatable lamp holder within the circumferential range of the rotation centerline;

the power source and the transmission mechanism are used to drive the rotatable lamp holder to rotate relative to the fixed lamp holder.

the light source assembly comprises a circuit board arranged on the rotatable lamp holder and a first light source arranged on the front of the circuit board and deviated from the rotation centerline.

the light source assembly further comprises a second light source arranged on the front of the circuit board and located at the rotation centerline.

there are multiple first light sources, and the first light source is arranged in at least one circle around the rotation centerline, wherein at least one first light source is provided in each circle.

at least two first light sources are provided in each circle, and the first light sources in the same circle are evenly distributed around the rotation centerline.

the first light source comprises a first LED chip and a first optical element arranged in the light emitting direction of the first LED chip.

the first optical element is a collimating lens.

the first optical elements are integrated on a mounting plate.

the light fixture further comprises an anti-glare cover arranged on the rotatable lamp holder and located in the light emitting direction of the light source assembly.

the anti-glare cover is a honeycomb anti-glare cover.

the light source assembly is provided with multiple light sources and arranged in a honeycomb type.

each hole of the honeycomb anti-glare cover faces an individual light source.

the power source is a motor.

the transmission mechanism adopts the form of belt transmission, chain transmission or gear transmission.

the power source is arranged on the fixed lamp holder, and the transmission mechanism comprises:

a driving gear, arranged on the fixed lamp holder and meshing with the output end of the power source;

a driven gear arranged on the rotatable lamp holder and meshing with the driving gear.

the light fixture further comprises a control circuit board arranged on the fixed lamp holder to supply power to the power source and provide forward and reverse control signals.

the fixed lamp holder and the rotatable lamp holder are provided with a bearing at the rotating connection.

the fixed lamp holder and the rotatable lamp holder are provided with a wire hole at the rotating connection.

the fixed lamp holder comprises:

bottom cover;

lamp tube, arranged on the bottom cover and the inner cavity is used to accommodate the rotatable lamp holder, the light source assembly, the power source and the transmission mechanism;

power source mounting seat arranged on the bottom cover and located in the lamp tube.

the power source mounting seat is provided with a bearing seat that is matched with the inner ring of the bearing, and the rotatable lamp holder is provided with an inner hole that is matched with the outer ring of the bearing.

Technical Effects of the Present Invention

The light fixture with rotatable light source of the present invention drives the light source assembly to rotate through the rotatable lamp holder, the light intensity changes during the light source assembly rotates around the center line of rotation. When the surface of the illuminated object is a prism structure, it will produce a sparkling effect especially suitable for jewelry lighting, so that jewelry is shining at all times, increasing consumers' desire to buy.

BRIEF DESCRIPTION OF THE DRAWINGS

The following describes embodiments of the present invention with reference to the accompanying drawings, in which.

DETAILED DESCRIPTION OF THE INVENTION

Hereinafter, specific embodiments of the present invention will be described in further detail based on the drawings. It should be understood that the description of the embodiments of the present invention is not intended to limit the protection scope of the present invention.

Embodiment 1

Figure 1:
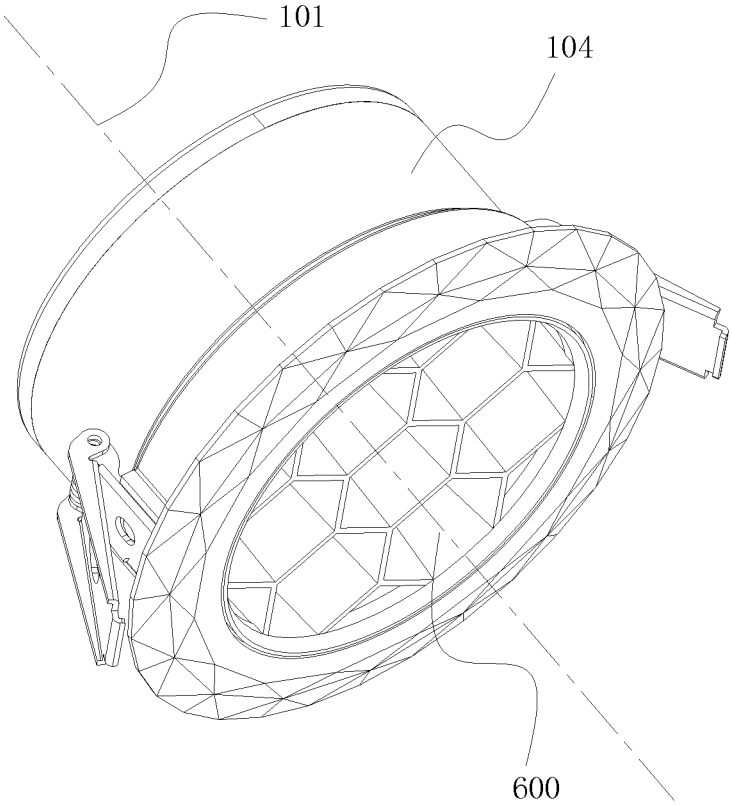
FIG. 1 is a schematic diagram of the structure of the light fixture with rotatable light source of embodiment 1.
Figure 2:
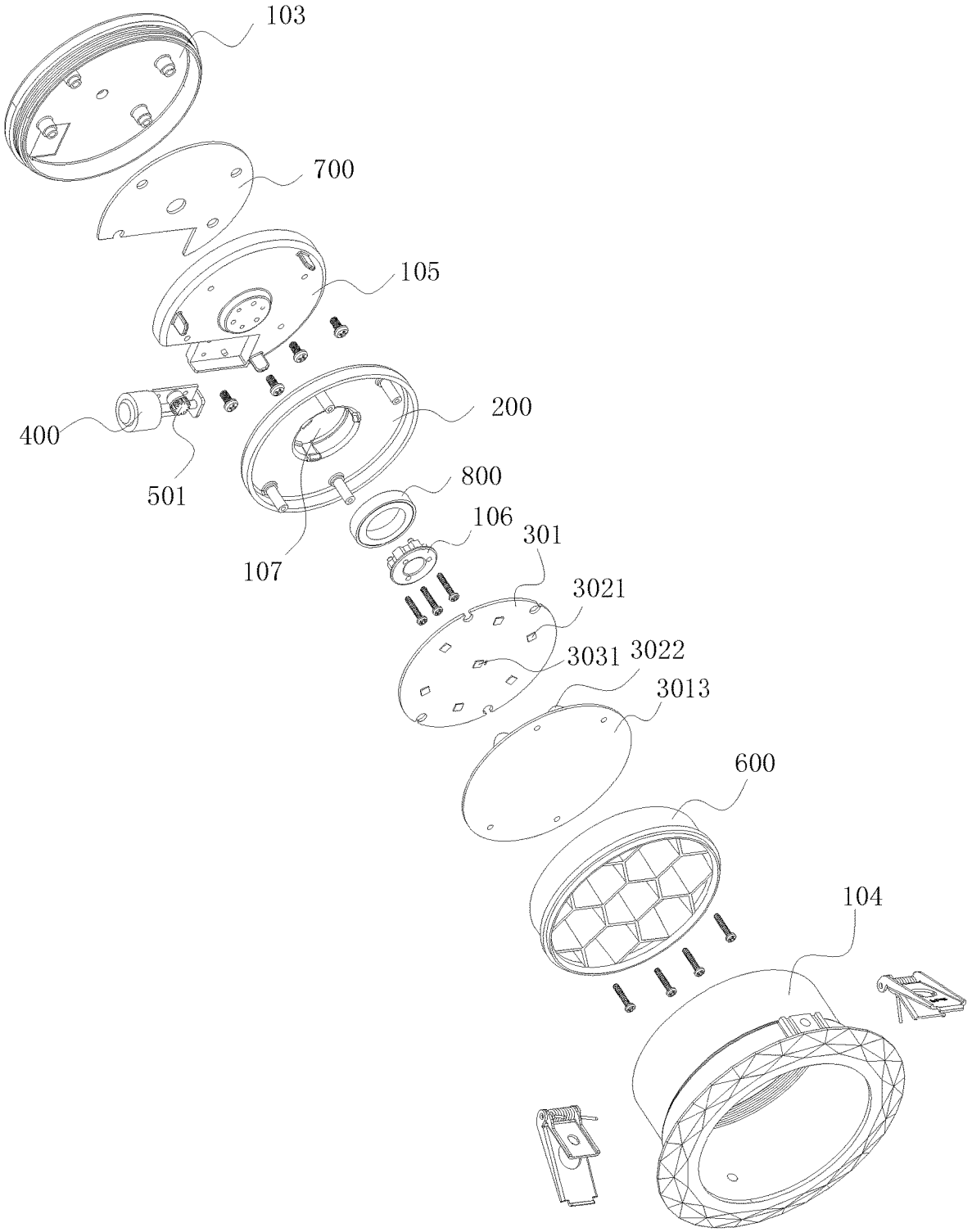
FIG. 2 is a schematic diagram of the exploded structure of the light fixture with rotatable light source of embodiment 1.
Figure 3:
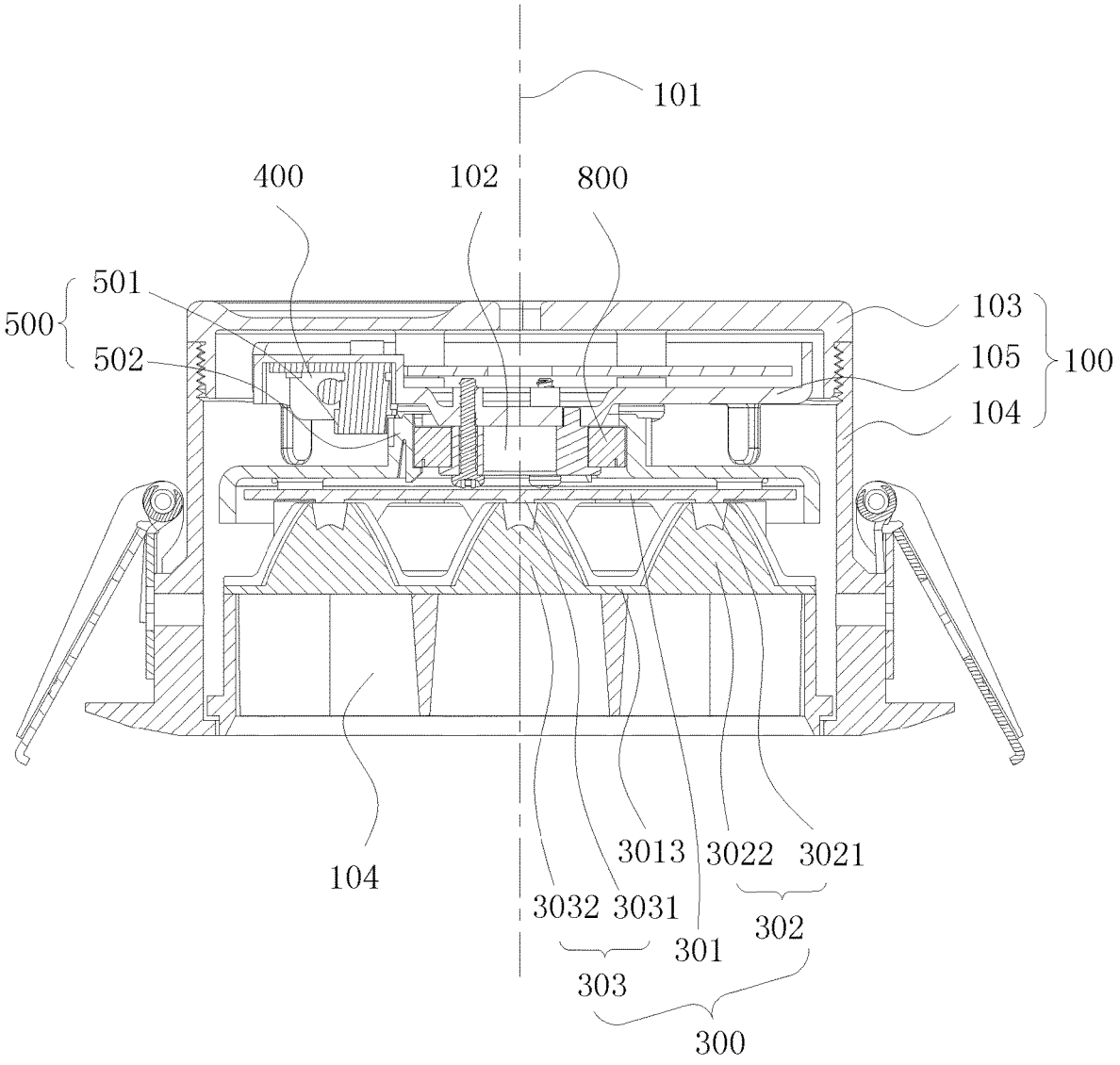
FIG. 3 is a schematic cross-sectional structure diagram of the light fixture with rotatable light source of embodiment 1.

As shown in FIGS. 1 to 3, the light fixture with rotatable light source of this embodiment includes a fixed lamp holder 100, a rotatable lamp holder 200, a light source assembly 300, a power source 400 and a transmission mechanism 500.

The fixed lamp holder 100 does not move and is used as a housing or other parts for supporting and installing other parts of the lamp. The fixed lamp holder 100 being a mounting seat for installing the rotatable lamp holder 200 has a rotation centerline 101; the rotatable lamp holder 200 rotates around the rotation centerline 101 and is installed on the fixed lamp holder 100; the rotating and installing setting here means the axial limit and axial rotation connection. The specific setting mode can be set according to the needs. The rotation connection can take place near the rotation centerline 101 or on the outer periphery far away.

The light source assembly 300 is arranged on the rotatable lamp holder 200 and rotates with the rotatable lamp holder 200. The light of the light source assembly 300 has strong and weak changes while rotating with the rotatable lamp holder 200 within the circumferential range of the rotation centerline 101. When the surface of the illuminated object is a prism structure or any other structure being with multiple surfaces that can reflect light from the light source to form emitting light with different light emitting angle and different light intensity, it will produce a sparkling effect on the surface due to the continuous change of reflected light, which is especially suitable for jewelry lighting.

The power source 400 and the transmission mechanism 500 are used to drive the rotatable lamp holder 200 to rotate relative to the fixed lamp holder 100. The power source 400 and the transmission mechanism 500 have many forms, and the final output power is to drive the rotatable lamp holder 200.

When the light source is set away from the rotation centerline 101, no matter how the light exit direction is set, generally, the light intensity of the light emitted from the light source changes when the rotatable lamp holder 200 rotates within the circumferential range of the rotation centerline 101, so that different reflected light is formed on the illuminated object, and the human eye can see the sparkling jewelry or other decorations without moving.

When the light source is set at the position of the rotation centerline 101, if the light exit direction coincides with the rotation centerline 101 and the light distribution in the circumferential direction is uniform, the light intensity of the light emitted from the light source will not change when the rotatable lamp holder 200 rotates within the circumferential range of the rotation centerline 101, then no sparkling effect take place; however, if the light exit direction is inclined with respect to the rotation centerline 101 or the light distribution in the circumferential direction is uneven, it can produce a sparkling effect when the rotatable lamp holder 200 rotates.

In this embodiment, the light source assembly 300 includes a circuit board 301 arranged on the rotatable lamp holder 200 and a first light source 302 arranged on the front of the circuit board 301 and deviated from the rotation centerline 101. Therefore, the light will change in intensity when the rotatable lamp holder 200 rotates within the circumferential range of the rotation centerline 101, resulting in a sparkling effect.

In order to make the light output of the whole lamp more uniform, there are multiple first light sources 302. The first light source 302 is arranged in at least one circle around the rotation centerline 101, wherein at least one first light source is provided in each circle. With this setting, the intensity changes of the light are achieved, but the changes are difficult to detect with the naked eye, which can prevent consumers from discovering that the lamp is rotating, and make the illuminated object shine more naturally. Further preferably, at least two first light sources 302 are provided in each circle, and the first light sources 302 in the same circle are evenly distributed around the rotation centerline 101.

In order to save energy, protect the environment and improve light efficiency, the first light source 302 in this embodiment includes a first LED chip 3021 and a first optical element 3022 arranged in the light-emitting direction of the first LED chip 3021. The first optical element 3022 can be used to package the first LED chip 3021 and distribute light for the first LED chip 3021, which can be set as needed.

In order to minish the light exit angle and improve the light efficiency, in this embodiment, the first optical element 3022 is a collimating lens. Of course, other lenses, convex lenses, special-shaped lenses, etc., can also be used, and optical elements such as reflectors can also be used, which can be selected according to the needs of light distribution. In order to make light emit regularly, the maximum intensity light output direction of the first light source 302 in this embodiment is parallel to the rotation centerline 101, and of course the tilt angle can be set. In this way, design is required to obtain the desired light-emitting effect, but there still will be a sparkling effect to achieve the purpose of the present invention. To facilitate manufacturing and installation, the first optical element 3022 is integrated on a mounting plate 3013, and the mounting plate 3013 is fixed on the circuit board 301.

In order to provide uniform illumination in the middle of the lamp, in this embodiment, the light source assembly 300 further includes a second light source 303 arranged on the front of the circuit board 301 and located at the rotation centerline 101. The second light source 303 includes a second LED chip 3031 and a second optical element 3032 arranged in the light emitting direction of the second LED chip 3031. The second optical element 3032 also uses a collimating lens and is also integrated on the mounting plate 3013.

In order to improve the anti-glare effect, in this embodiment the light fixture further includes an anti-glare cover 600 arranged on the rotatable lamp holder 200 in the light emitting direction of the light source assembly 300. In order to improve the shading effect, further, the anti-glare cover 600 is a honeycomb anti-glare cover. In order to ensure the light emitting efficiency at the same time, the light source assembly 300 is provided with multiple light sources and arranged in a honeycomb type, and each hole of the honeycomb anti-glare cover faces an individual light source.

There are many types of power source 400 that can be used to achieve power output. In this embodiment, for the convenience of obtaining materials, the power source 400 uses a motor.

The transmission mechanism 500 adopts the form of belt transmission, chain transmission or gear transmission. In this embodiment, the transmission mechanism 500 is gear transmission. The power source 400 can be arranged on the fixed lamp holder 100 or the rotatable lamp holder 200. In this embodiment, the power source 400 is arranged on the fixed lamp holder 100. The transmission mechanism 500 includes a driving gear 501 arranged on the fixed lamp holder 100 and meshing with the output end of the power source 400 and a driven gear 502 arranged on the rotatable lamp holder 200 and meshing with the driving gear 501.

In order to control the output of the power source 400, in this embodiment, the lamp further includes a control circuit board 700 arranged on the fixed lamp holder 100 to supply power to the power source 400 and provide forward and reverse control signals. The control circuit board 700 can be integrated into the power source 400 or integrated into the light source assembly 300, and can be designed according to structural requirements.

In this embodiment, the fixed lamp holder 100 and the rotatable lamp holder 200 are provided with a bearing 800 at the rotating joint, which makes the rotation more stable.

The fixed lamp holder 100 and the rotatable lamp holder 200 are provided with a wire hole 102 at the rotating connection. Thus, the wires of the light source assembly 300 can be led out of the lamp body. Here, electric brushes can also be used to realize rotating electrical connection, so as to avoid twisting of wires. The wire hole 102 can also be used to lead out wires of the control circuit board 700.

The specific structure of the fixed lamp holder 100 can be set as required. In this embodiment, in order to facilitate installation while encapsulating other parts of the entire lamp, the fixed lamp holder 100 of this embodiment includes a bottom cover 103, a lamp tube 104 and a power source mounting seat 105. Wherein, the lamp tube 104 is arranged on the bottom cover 103, and the inner cavity is used to accommodate the rotatable lamp holder 200, the light source assembly 300, the power source 400 and the transmission mechanism 500; the power source mounting seat 105 is arranged on the bottom cover 103 and located in the lamp tube 104. In order to facilitate installation, the bottom cover 103 and the lamp tube 104 are screwed together.

The power source mounting seat 105 is provided with a bearing seat 106 that is matched with the inner ring of the bearing 800, and the rotatable lamp holder 200 is provided with an inner hole 107 that is matched with the outer ring of the bearing 800. The bearing seat 106 and the power source mounting seat 105 are arranged separately, making the installation more convenient.

Embodiment 2

Figure 4:
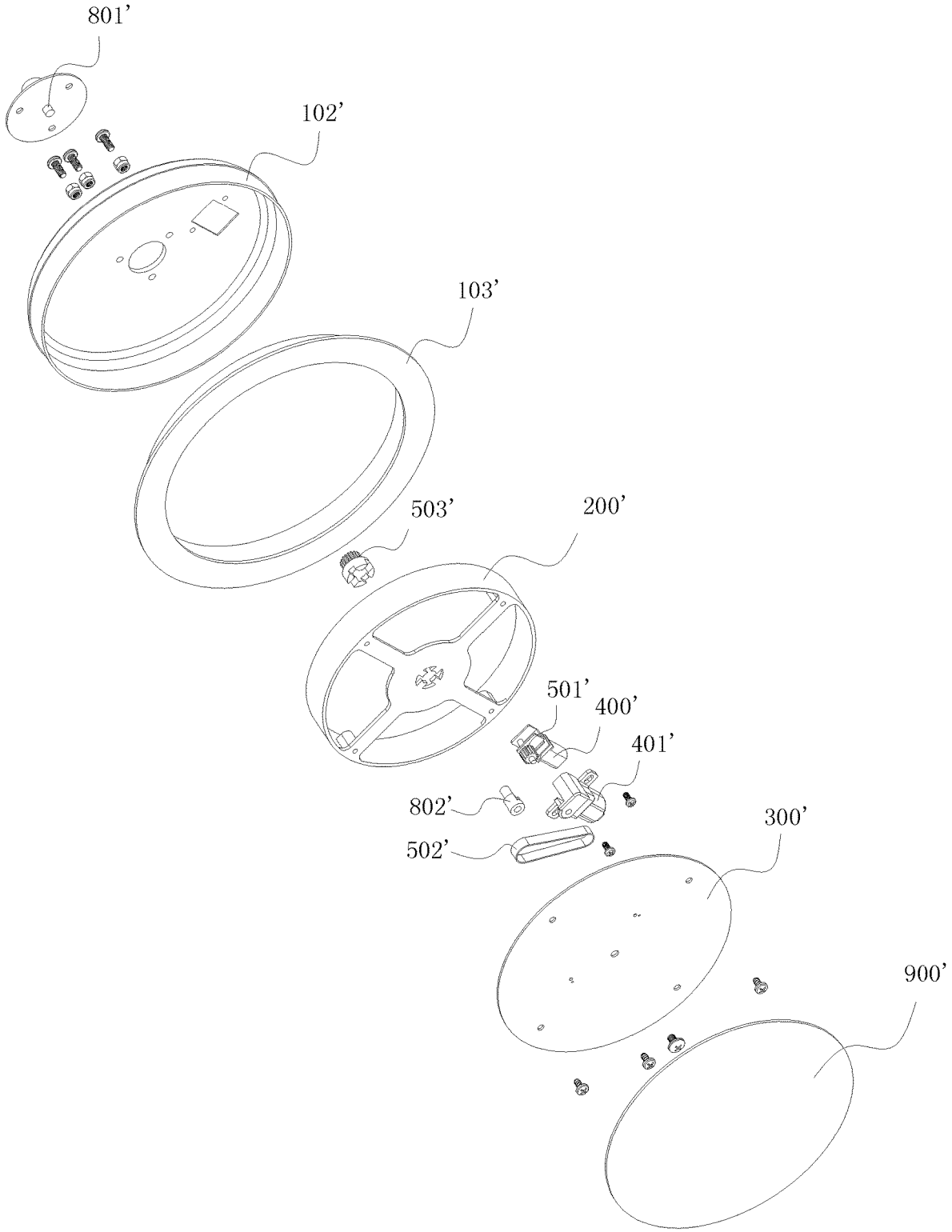
FIG. 4 is a schematic diagram of the exploded structure of the light fixture with rotatable light source of embodiment 2.
Figure 5:
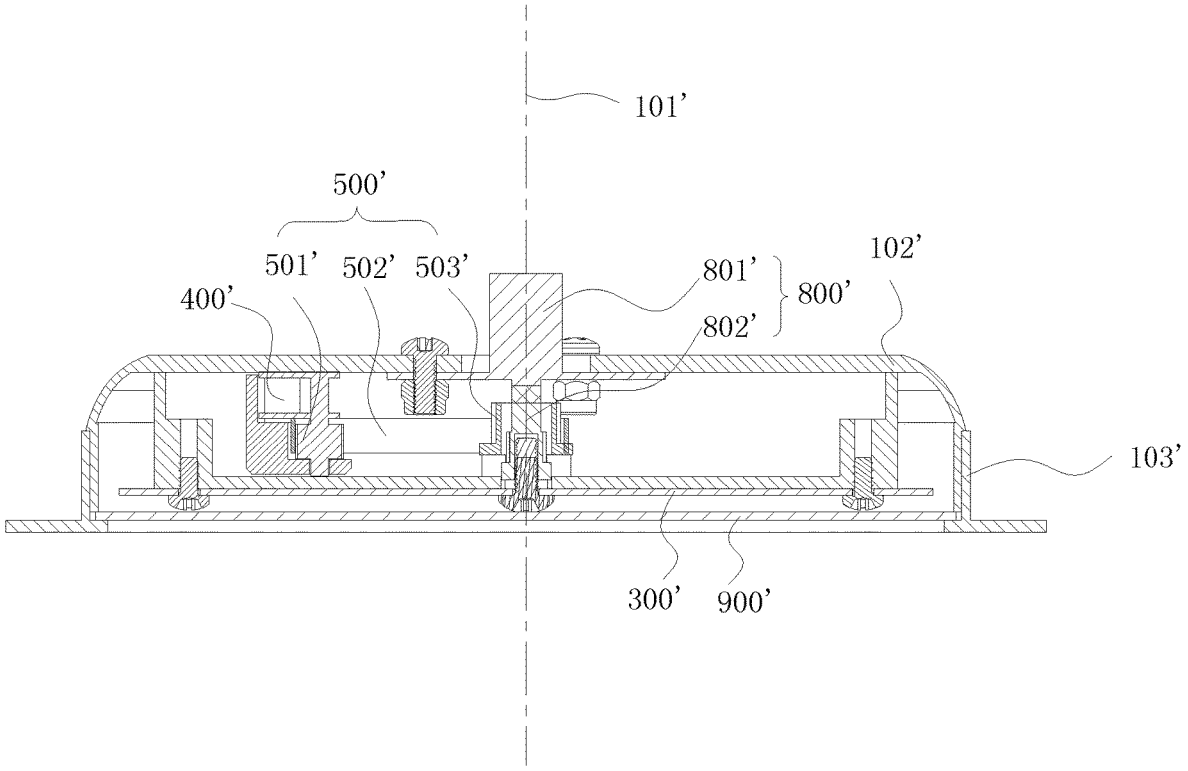
FIG. 5 is a schematic cross-sectional structure diagram of the light fixture with rotatable light source of embodiment 2.

As shown in FIGS. 4 and 5, in this embodiment, the transmission mechanism 500' adopts belt transmission, and a brush 800' is added to realize the power supply of the light source assembly 300'.

Specifically, the rotatable light source lamp of this embodiment includes a fixed lamp holder 100', a rotatable lamp holder 200', a light source assembly 300', a power source 400', a transmission mechanism 500', and a lamp shade 900'.

The fixed lamp holder 100' with a rotation centerline 101 includes a lamp housing 102' and a top cover 103'. A fixed part 801' of the brush 800' is set at the intersection position of the lamp housing 102' and the rotation centerline 101'. One end of a rotating part 802' of the brush 800' is connected to the fixed part 801', and the other end is fixedly connected to the rotatable lamp holder 200'. In this embodiment, the light source assembly 300', the rotatable lamp holder 200' and the rotating part 802' is fixed together by screws.

The power source 400' adopts a motor with a motor bracket 401'. The motor bracket 401' fixes the motor on the bottom surface of the lamp housing 102'. The transmission mechanism 500' includes a driving gear 501' connected with the output end of the motor, a transmission belt 502', and a driven gear 503' fixed on the back of the rotatable lamp holder 200' and located on the outer periphery of the fixed part 801'.

The light source assembly 300' includes a circuit board and LED chips arranged thereon. The arrangement of the LED chips is the same as that of the first embodiment, and the rotating part 802' is electrically connected to the circuit board for power supply.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A light fixture with rotatable light source, comprising:

a fixed lamp holder (100), a rotatable lamp holder (200), a light source assembly (300), a power source (400), a transmission mechanism (500), and an anti-glare cover (600), wherein the rotatable lamp holder (200) has an inner protruding rim and a rotation centerline (101), the rotatable lamp holder (200) rotates around the rotation centerline (101) and is arranged on the fixed lamp holder (100), the light source assembly (300) is arranged on the rotatable lamp holder (200), and light of the light source assembly (300) has strong and weak changes while rotating with the rotatable lamp holder (200) within the circumferential range of the rotation centerline (101), the power source (400) and the transmission mechanism (500) are used to drive the rotatable lamp holder (200) to rotate relative to the fixed lamp holder (100), the anti-glare cover (600) is arranged on the rotatable lamp holder (200);

the rotatable lamp holder (200) has an inner hole (107) circumscribed by a circular wall and a bearing (800) is fitted inside the inner hole (107), a driven gear (502) of the transmission mechanism (500) is disposed on an exterior wall of the inner protruding rim of the rotatable lamp holder (200), and the driven gear (502) meshes with a driving gear (501) attached to an output end of the power source (400).

2. The light fixture with rotatable light source as claimed in claim 1, wherein the light source assembly (300) comprises a circuit board (301) arranged on the rotatable lamp holder (200) and a first light source (302) arranged on the front of the circuit board (301) and deviated from the rotation centerline (101).

3. The light fixture with rotatable light source as claimed in claim 2, wherein the light source assembly (300) further comprises a second light source (303) arranged on the front of the circuit board (301) and located at the rotation centerline (101).

4. The light fixture with rotatable light source as claimed in claim 2, wherein there are multiple first light sources (302), and the first light source (302) is arranged in at least one circle around the rotation centerline (101), wherein at least one first light source is provided in each circle.

5. The light fixture with rotatable light source as claimed in claim 4, wherein at least two first light sources (302) are provided in each circle, and the first light sources (302) in the same circle are evenly distributed around the rotation centerline (101).

6. The light fixture with rotatable light source as claimed in claim 2, wherein the first light source (302) comprises a first LED chip (3021) and a first optical element (3022) arranged in the light emitting direction of the first LED chip (3021).

7. The light fixture with rotatable light source as claimed in claim 6, wherein the first optical element (3022) is a collimating lens.

8. The light fixture with rotatable light source as claimed in claim 6, wherein the first optical elements (3022) are integrated on a mounting plate (3013).

9. The light fixture with rotatable light source as claimed in claim 1, wherein the anti-glare cover (600) is located in the light emitting direction of the light source assembly (300).

10. The light fixture with rotatable light source as claimed in claim 9, wherein the anti-glare cover (600) is a honeycomb anti-glare cover.

11. The light fixture with rotatable light source as claimed in claim 10, wherein the light source assembly (300) is provided with multiple light sources and arranged in a honeycomb type.

12. The light fixture with rotatable light source as claimed in claim 11, wherein each hole of the honeycomb anti-glare cover faces an individual light source.

13. The light fixture with rotatable light source as claimed in claim 1, wherein the power source (400) is a motor.

14. The light fixture with rotatable light source as claimed in claim 1, wherein the transmission mechanism (500) adopts the form of belt transmission, chain transmission or gear transmission.

15. The light fixture with rotatable light source as claimed in claim 1, wherein the light fixture further comprises a control circuit board (700) arranged on the fixed lamp holder (100) to supply power to the power source (400) and provide forward and reverse control signals.

16. The light fixture with rotatable light source as claimed in claim 1, wherein the fixed lamp holder (100) and the rotatable lamp holder (200) are provided with the bearing (800) at the rotating connection.

17. The light fixture with rotatable light source as claimed in claim 1, wherein the fixed lamp holder (100) and the rotatable lamp holder (200) are provided with a wire hole (102) at the rotating connection.

18. The light fixture with rotatable light source as claimed in claim 1, wherein the fixed lamp holder (100) comprises:

bottom cover (103);

lamp tube (104), arranged on the bottom cover (103), and the inner cavity is used to accommodate the rotatable lamp holder (200), the light source assembly (300), the power source (400) and the transmission mechanism (500);

and power source mounting seat (105), arranged on the bottom cover (103) and located in the lamp tube (104).

19. The light fixture with rotatable light source as claimed in claim 18, wherein the power source mounting seat (105) is provided with a bearing seat (106) that is matched with the inner ring of the bearing (800), and the inner hole (107) of the rotatable lamp holder (200) is matched with the outer ring of the bearing (800).

20. A light fixture with rotatable light source, comprising:

a fixed lamp holder (100), a rotatable lamp holder (200), a light source assembly (300), a power source (400), a transmission mechanism (500), and an anti-glare cover (600);

wherein the power source (400) is arranged on the fixed lamp holder (100), the fixed lamp holder (100) has a rotation centerline (101), the rotatable lamp holder (200) rotates around the rotation centerline (101) and is arranged on the fixed lamp holder (100), the rotatable lamp holder (200) having an inner protruding rim, the light source assembly (300) is arranged on the rotatable lamp holder (200), and light of the light source assembly (300) has strong and weak changes while rotating with the rotatable lamp holder (200) within the circumferential range of the rotation centerline (101), the power source (400) and the transmission mechanism (500) are used to drive the rotatable lamp holder (200) to rotate relative to the fixed lamp holder (100), and the transmission mechanism (500) further comprises:

a driving gear (501), arranged on the fixed lamp holder (100) and meshing with the output end of the power source (400);

and a driven gear (502) disposed on an exterior wall of the inner protruding rim of the rotatable lamp holder (200) and meshing with the driving gear (501); and the anti-glare cover (600) is arranged on the rotatable lamp holder (200).

* * * * *